US012758010B2

(12) United States Patent
Schmidig et al.

(10) Patent No.: US 12,758,010 B2
(45) Date of Patent: Oct. 13, 2026

(54) SUSPENSION DEVICE FOR A SHELF

(71) Applicant: Peka-Metall AG, Mosen (CH)

(72) Inventors: Adrian Schmidig, Beinwil am See (CH); Bernhard Weber, Beinwil am See (CH)

(73) Assignee: Peka-Metall AG, Mosen (CH)

( * ) Notice: Subject to any disclaimer, the term of this patent is extended or adjusted under 35 U.S.C. 154(b) by 0 days.

(21) Appl. No.: 19/271,426

(22) Filed: Jul. 16, 2025

(65) Prior Publication Data

US 2026/0026618 A1 Jan. 29, 2026

(30) Foreign Application Priority Data

Jul. 24, 2024 (EP) ..... 24190521

(51) Int. Cl.
*A47B 57/32* (2006.01)
*A47B 47/00* (2006.01)

(52) U.S. Cl.
CPC ..... *A47B 57/32* (2013.01); *A47B 47/00* (2013.01)

(58) Field of Classification Search
CPC ..... A47B 57/32; A47B 47/00; A47B 88/42; A47B 57/34; A47B 57/425; A47F 5/103
USPC ..... 211/144, 150, 186; 248/235, 240, 242, 248/250
See application file for complete search history.

(56) References Cited

U.S. PATENT DOCUMENTS 2,982,423 A 5/1961 Handler et al.
3,151,576 A * 10/1964 Patterson ..... A47F 5/0087 248/242
9,404,645 B1 * 8/2016 Feng ..... A47B 57/36
12,185,834 B1 * 1/2025 Chen ..... A47B 57/402
2007/0158289 A1 * 7/2007 Chen ..... A47B 47/00 211/186
2008/0121146 A1 * 5/2008 Burns ..... A47F 11/10 362/125
2008/0272076 A1 11/2008 Davenport
2010/0140201 A1 * 6/2010 Andersen ..... A47F 1/12 211/150
2011/0215693 A1 * 9/2011 Golias ..... A47B 88/90 312/330.1
2015/0173529 A1 * 6/2015 Hester-Redmond ..... A47F 5/08 211/186
2019/0307247 A1 * 10/2019 Weber ..... A47B 88/9418
(Continued)

FOREIGN PATENT DOCUMENTS

IT 201800004629 A1 10/2019
IT 202100025883 A1 4/2023

*Primary Examiner* — Muhammad Ijaz
(74) *Attorney, Agent, or Firm* — Hard IP Professional Services LLC

(57) ABSTRACT

A suspension device comprises at least one shelf and a retaining frame, wherein the shelf has a base surface, a first side wall, a second side wall, a front wall, and a rear wall. The front wall is arranged opposite the rear wall and the first side wall is arranged opposite the second side wall, and the walls enclose the base surface. The retaining frame is configured as a profile element with a hollow profile. The retaining frame has a front side which is arranged adjacent to the rear wall of the at least one shelf, and a rear side which is arranged opposite the front side. At least one of the first or second side walls or the rear wall contains a projection which is configured to be received in a slot of the retaining frame. The at least one slot is arranged on the rear side.

15 Claims, 2 Drawing Sheets

(56) References Cited

U.S. PATENT DOCUMENTS

| | | | | |
|---|---|---|---|---|
| 2021/0026424 | A1* | 1/2021 | Vardaro | A47F 11/10 |
| 2021/0030149 | A1* | 2/2021 | Carrasco López | A47B 57/34 |
| 2021/0085100 | A1* | 3/2021 | Bersagel | A47B 88/48 |
| 2023/0012176 | A1* | 1/2023 | Cheng | A47B 57/42 |
| 2023/0128940 | A1* | 4/2023 | Johnson | A47F 5/108<br>248/558 |
| 2024/0341467 | A1* | 10/2024 | Chandrashekaraiah | A47B 57/50 |
| 2025/0000254 | A1* | 1/2025 | Li | A47B 57/42 |
| 2025/0024945 | A1* | 1/2025 | Ruiz | A47F 5/005 |
| 2026/0026618 | A1* | 1/2026 | Schmidig | A47B 57/32 |

* cited by examiner

Detail A

Detail B

SUSPENSION DEVICE FOR A SHELF

CROSS-REFERENCE TO RELATED APPLICATIONS

This application claims the benefit of European patent application no. EP 24190521.5, filed Jul. 24, 2024, the contents of which is incorporated herein by reference in its entirety.

TECHNICAL FIELD

The present invention relates to a suspension device for a shelf. Suspension devices for shelves are used for furniture containing shelves on which objects are stored on several levels.

DESCRIPTION OF RELATED ART

Document U.S. Pat. No. 2,982,423 A shows a generic suspension device for shelves. Each shelf has two hook-like projections that are inserted into corresponding slots in a retaining frame. The hook-like projections are designed so that first an upper hook-like projection of the shelf is inserted into an upper slot in a position tilted toward the installation position. The shelf is then tilted into the installation position, causing the lower hook-like projection to be inserted into the adjacent slot below. Both hook-like projections have downward-facing recesses which engage with the wall of the retaining frame when installed. The two hook-like projections are formed on the rear wall of the shelf. They engage with corresponding slots located on the front side of the retaining frame.

A disadvantage of the previously known suspension device is that the slots on the retaining frame remain visible, which are not required for a shelf. This solution has proven advantageous for using the shelf for storing goods in a retail store, as it is easy to assemble and modularly expandable. In furniture construction, however, the visibility of the slots in the support frame may be undesirable for aesthetic reasons. For this reason, US2008/0272076 A1 proposed arranging the slots on the side of the retaining frame. However, this solution requires the use of a holder for the shelf. The holder consists of two arms, each with two hook-like projections arranged one above the other at the ends. When the holder is to be mounted, the two arms are spread apart. The projections must be positioned exactly over the slots so that when the arms are returned to their original position, the projections engage in the slots and the holder can then be moved into the installation position. The downward-facing notches also accommodate the two side walls of the holder frame. The shelves can only be installed after the holders have been attached. This solution therefore requires several assembly steps and the slots are still visible from the side. This disadvantage is particularly noticeable in cabinets with swivel shelves, such as those used in pull-out cabinets.

Document IT201800004629 A1 proposes a retaining frame with a plurality of window-like slots arranged on the rear side. The window-like slots are thus invisible when installed. A bracket element is inserted into these window-like slots. The bracket element has a body formed from a metal plate, which contains two laterally opposite bracket arms. The bracket arms are configured to be received in a U-shaped frame arranged on the upper side of a rear wall of a shelf. Two hook elements are arranged one above the other on the body of the bracket element and are intended for insertion into the window-like slots of the holder frame. To mount the shelf, the bracket element is positioned at the desired height and then the shelf with the U-shaped frame is placed on the bracket arms. If this assembly is carried out before installation in a cabinet, this is easy to do as the bracket element is easily accessible from the rear. Once the retaining frame with the bracket elements and shelves has been installed in the cabinet, the bracket element is located between the rear wall or door of the cabinet and the retaining frame. The bracket element is difficult to access when installed, especially if several shelves are to be mounted. This makes it difficult for the user to change the number and/or spacing of the individual shelves after installation, as the bracket element in particular is difficult to access. In addition, the view may be obstructed by shelves that have already been installed, making it difficult for the user to find the desired installation position once the unit is installed.

SUMMARY OF THE INVENTION

Therefore, the object of the invention is to develop a suspension device that is not only easy to install, but can also be easily adjusted in height subsequently. The suspension device should also have a retaining frame with slots into which shelves that can be pivoted around a vertical axis can be hung and removed again as required. The slots in the holder frame should remain invisible to the user.

When the term "for example" is used in the following description, this term refers to examples of embodiments and/or variants, which are not necessarily to be understood as a preferred application of the invention. Similarly, the terms "preferably" and "preferred" should be understood as referring to an example from a set of embodiments and/or variants, which should not necessarily be understood as a preferred application of the invention. Accordingly, the terms "for example," "preferably," or "preferred" may refer to a plurality of embodiments and/or variants.

The following detailed description contains various examples of embodiments of the suspension device according to the invention. The description of a specific suspension device is to be regarded as merely exemplary. In the description and claims, the terms "contain," "comprise," and 'have' are interpreted as "contain, but are not limited to."

A suspension device according to the invention comprises at least one shelf and a retaining frame, wherein the shelf has a base surface, a first side wall, a second side wall, a front wall, and a rear wall. The front wall is arranged opposite the rear wall and the first side wall is arranged opposite the second side wall. The first side wall, the front wall, the second side wall, and the rear wall enclose the base surface. The retaining frame is configured as a profile element with a hollow profile. The retaining frame has a front side which is arranged adjacent to the rear wall of the at least one shelf. Furthermore, the retaining frame has a rear side which is arranged opposite the front side. At least one of the first or second side walls or the rear wall contains a projection which is configured to be received in a slot in the retaining frame.

The at least one slot is located on the rear side. In particular, the front side is free of slots. The front side thus presents itself to the viewer as a continuous surface, which on the one hand is considered aesthetically appealing and on the other hand is easy to clean if any liquid splashes onto the front side. The base can be rectangular in shape. A shelf with a rectangular base allows optimal use of the storage space. The slot can be configured as a long hole. Instead of a slot, recesses with an oval cross-section can also be provided. Slots with a polygonal cross-section are also possible. The term "slot" therefore encompasses any recess that has a different opening width in two different directions. The opening width is measured along two axes passing through the center of gravity, which form an angle with each other, in particular two axes that are orthogonal to each other.

According to an embodiment, a first side surface and a second side surface extend between the front side and the rear side, wherein at least one of the first and second side surfaces is free of slots. It is particularly advantageous if both the first and second side surfaces are free of slots. According to this embodiment, the observer sees a continuous surface not only from the front but also from the side(s). In addition, a continuous surface can be more easily subjected to subsequent surface treatment, such as painting, if there are no recesses, openings, or slots on the visible surface or surfaces. According to an embodiment, the hollow profile is designed as a square profile.

According to an embodiment, the projection comprises a first projection section and a second projection section. A projection designed according to this embodiment makes it particularly easy to hook the shelf into the retaining frame. In particular, a notch is arranged between the first projection section and the second projection section. This notch makes it particularly easy to manufacture the first projection section and the second projection section. In particular, the first projection section can be bent around two different bending lines that are vertical when installed, so that the first projection section has a U-shape when viewed from above. In particular, the first projection section contains a suspension element which is configured to be received in the slot of the retaining frame.

According to an embodiment, the second projection section is configured as a support element that is configured to rest on the rear side of the retaining frame. According to this embodiment, the shelf can be easily guided along the retaining frame.

Each of the side walls contains a groove extending from the rear wall toward the front wall, so that the side wall can be divided into an upper wall section and a lower wall section by the groove. In particular, the groove may have a length in the range of 10% up to and including 40% of the total length of the first side wall or the second side wall. This groove gives the upper wall section sufficient elasticity to be deflected during assembly or disassembly so that this upper wall section can engage with the retaining frame with the projection.

According to an embodiment, the upper part wall section contains the projection and the first projection section contains a suspension element. The first projection section is thus configured to contain the suspension element, which, when installed, can be hooked into a corresponding slot on the rear side of the retaining frame. The suspension element has a greater depth than the first projection section. This allows the suspension element to rest with its lower end on the inside of the rear side of the retaining frame. The suspension element can be configured as a hooking element.

According to an embodiment, the upper wall section can be deflected relative to the lower wall section so that the projection can be guided around the retaining frame in order to bring the suspension element into engagement with the slot. In particular, a groove may be arranged between the upper wall section and the lower wall section so that the upper wall section is decoupled from the lower wall section in the area of the groove. The lower wall section is connected in particular to the base surface of the shelf.

According to an embodiment, the rear wall has a distance from each of the first and second side walls which is slightly greater than the distance between the side surface and the opposite side surface of the retaining frame, so that the retaining frame can be mounted between the first side wall and the rear wall or between the second side wall and the rear wall. According to an embodiment, the distance can be formed as a cutout. According to this embodiment, two retaining frames are provided for each of the shelves.

According to an embodiment, the first and second side walls project beyond the rear wall so that the corresponding first or second side wall can rest on the corresponding first or second side surface of the retaining frame when installed. Each of the first or second side surfaces can in particular comprise the corresponding first or second outer side surfaces.

The invention further comprises an extendable cabinet element containing a suspension device according to any one of the preceding embodiments.

The invention further comprises a rotatable or pivotable cabinet element containing a suspension device according to any one of the preceding embodiments.

BRIEF DESCRIPTION OF THE DRAWINGS

The suspension device according to the invention is described below with reference to a few exemplary embodiments. It is shown in FIG. 1 a first view of a suspension device, FIG. 2 a detail A of FIG. 1, FIG. 3 a second view of the suspension device according to FIG. 1, FIG. 4 a detail B of FIG. 1.

DETAILED DESCRIPTION

Figure 1:
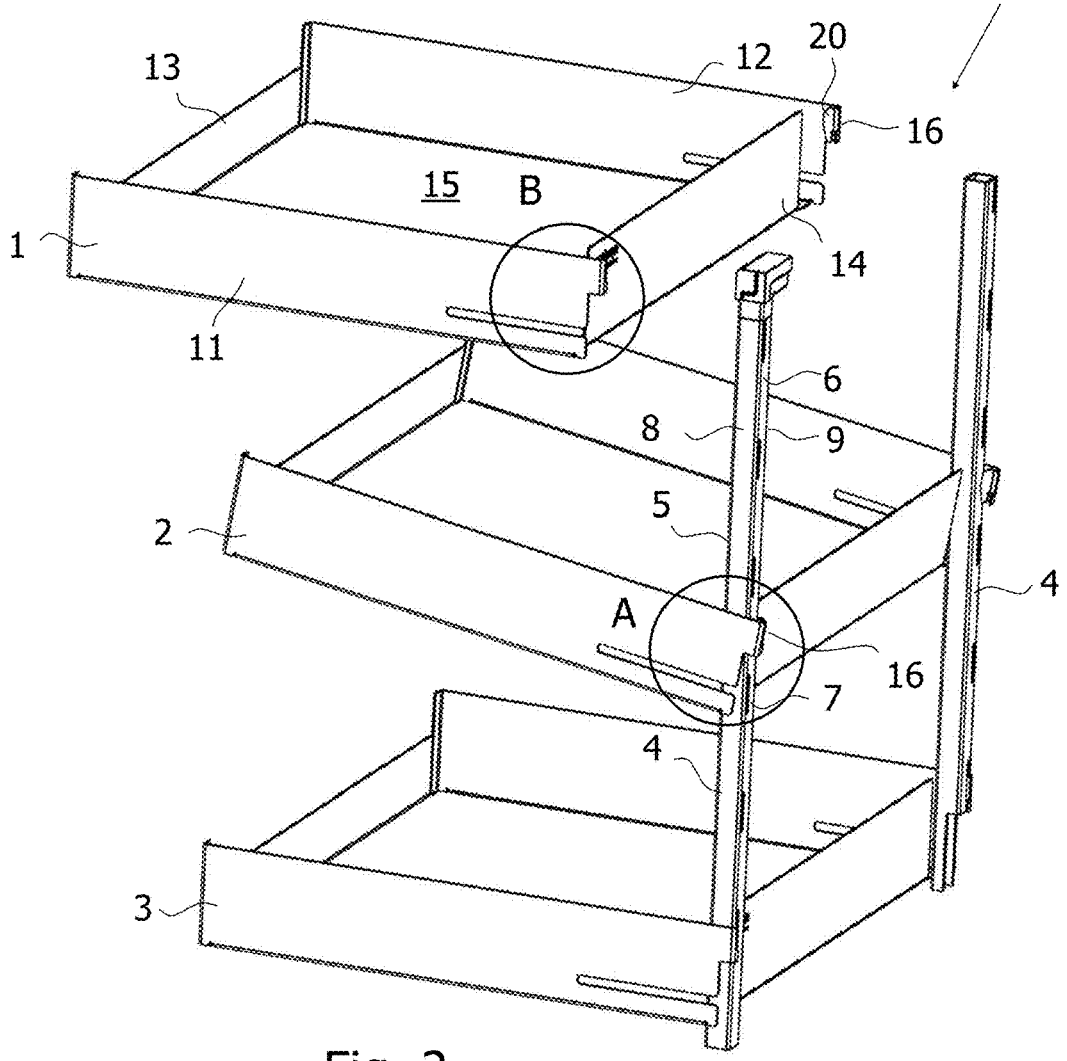

FIG. 1 shows a first view of a suspension device 10 comprising at least one shelf 1, 2, 3 and a support frame 4. Each of the three shelves 1, 2, 3 shown has a base surface 15, a first side wall 11, a second side wall 12, a front wall 13 and a rear wall 14. The front wall 13 is arranged opposite the rear wall 14 and the first side wall 11 is arranged opposite the second side wall 12. The first side wall 11, the front wall 13, the second side wall 12, and the rear wall 14 enclose the rectangular base surface 15.

The retaining frame 4 is configured as a profile element with a hollow profile, wherein the retaining frame 4 has a front side 5 which is formed adjacent to the rear wall 14 of each of the three exemplary shelves 1, 2, 3. The retaining frame 4 has a rear side 6 which is arranged opposite the front side 5. At least one of the first or second side walls 11, 12 or the rear wall 14 contains a projection 16 which is configured to be received in a slot 7 of the retaining frame 4. The at least one slot 7 is arranged on the rear side 6. According to the present embodiment, the front side 5 is free of slots.

According to the present embodiment, a first side surface 8 and a second side surface 9 extend between the front side 5 and the rear side 6, wherein at least one of the first and second side surfaces 8, 9 is free of slots. According to this embodiment, the hollow profile is designed as a square profile. According to this embodiment, the profile element has a rectangular cross-section.

Figure 2:
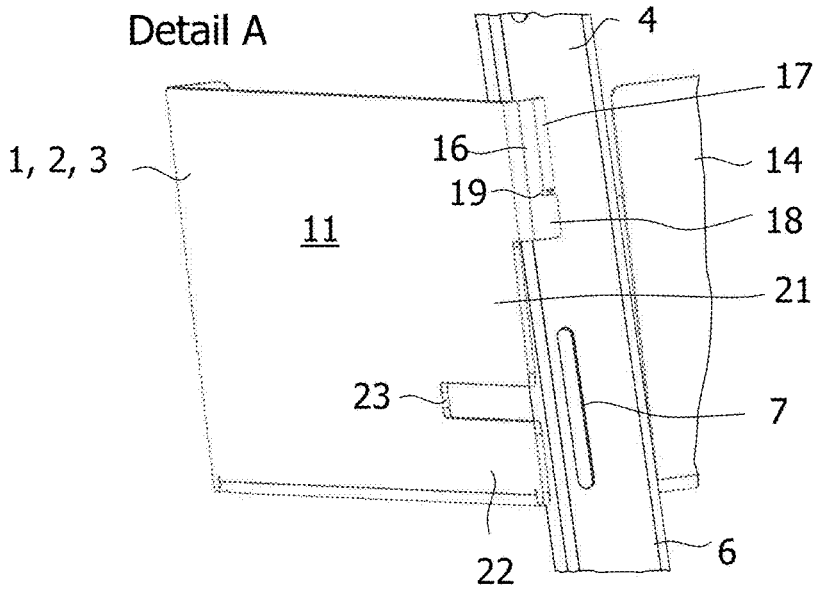

According to the present embodiment, the projection 16 comprises a first projection section 17 and a second projection section 18, which is more clearly visible in the detail A shown in FIG. 2. In particular, a notch 19 is arranged between the first projection section 17 and the second projection section 18. In particular, the first projection section contains a suspension element 20, which is configured to be received in the slot 7 of the retaining frame 4. According to the present exemplary embodiment, the second projection section 18 is configured as a support element which is configured to rest on the rear side 6 of the retaining frame 4.

According to the present embodiment, each of the side walls 11, 12 contains a groove 23 extending from the rear wall 14 toward the front wall 13, so that the side wall 11, 12 can be divided into an upper wall section 21 and a lower wall section 22 by the groove 23.

According to the present embodiment, the groove has a length which lies in the range of 10% up to and including 40% of the total length of the first side wall 11 or the second side wall 12.

According to the present embodiment, the upper wall section 21 contains the projection 16. Thus, in particular, the upper wall section 21 is deflectable relative to the lower wall section 22, so that the projection 16 can be guided around the retaining frame 4 in order to bring the suspension element 20 into engagement with the slot 7.

According to the present embodiment, the rear wall 14 has a distance from each of the first and second side walls which is slightly greater than the distance between the side surface 8 and the opposite side surface 9 of the retaining frame, so that the corresponding retaining frame 4 is configured to be received for assembly between the first side wall 11 and the rear wall 14 or between the second side wall 12 and the rear wall 14.

In particular, the first side wall 11 and the second side wall 12 can project beyond the rear wall 14 so that the corresponding first or second side wall 11, 12 can rest on the corresponding outer side surface 8, 9 of the retaining frame 4 when installed.

Figure 3:
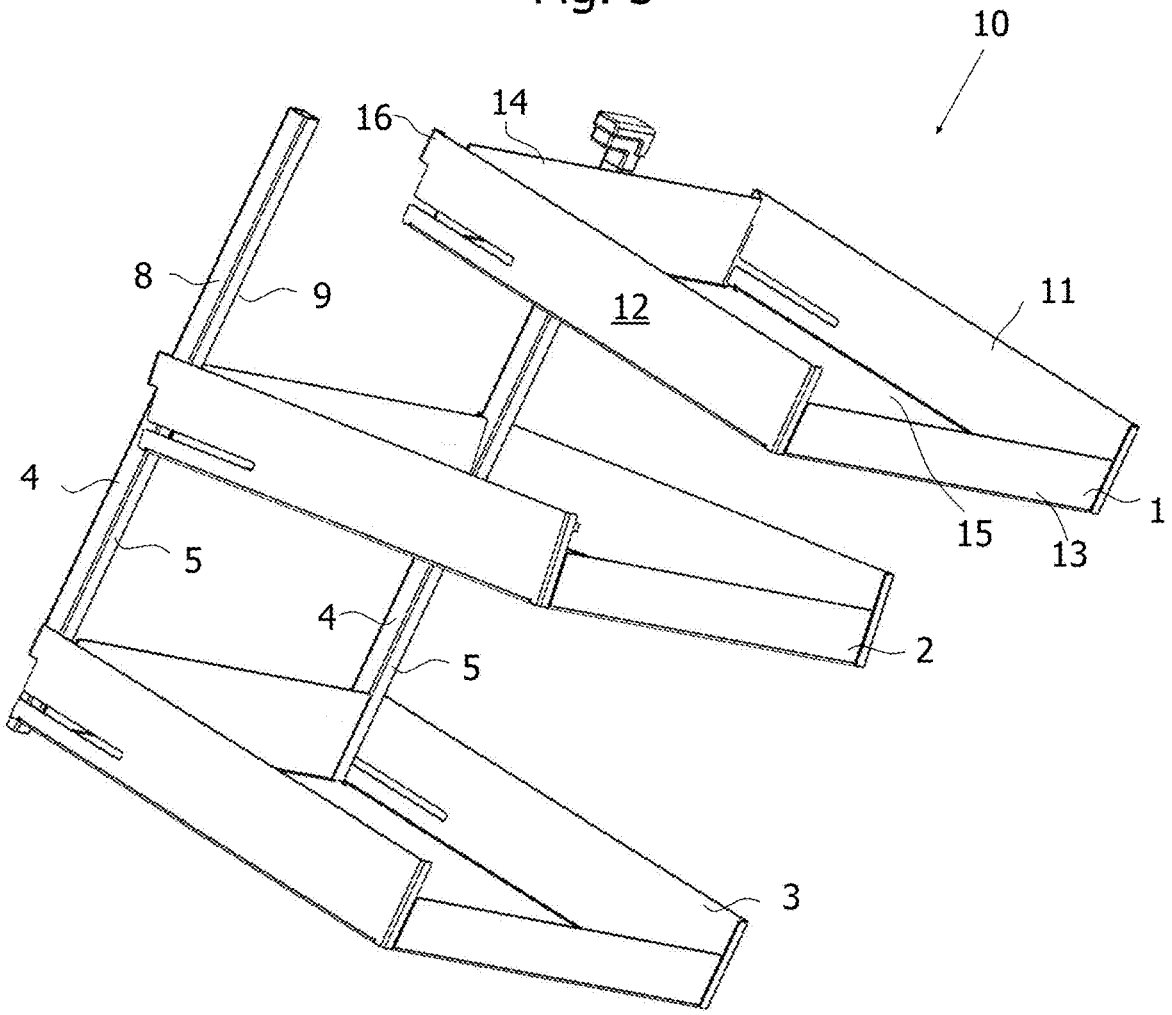

FIG. 3 shows a second view of the suspension device according to FIG. 1 from the opposite side. The top shelf 1 in the illustration is shown in a dismantled state. The middle shelf 2 is being hung and the bottom shelf 3 in the illustration is shown in a hung state.

Figure 4:
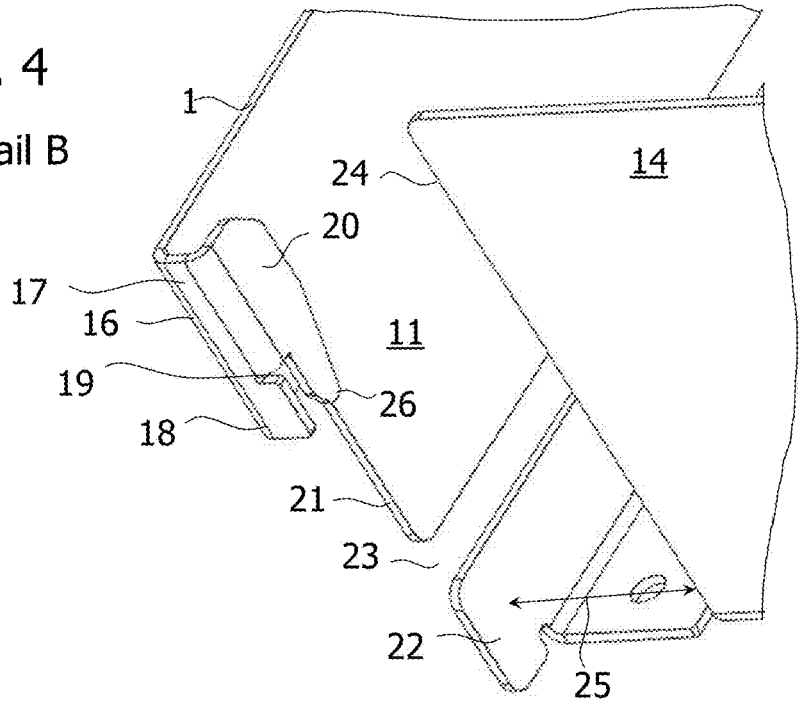

FIG. 4 shows a detail B of FIG. 1, which shows the similar projection 16 of the first shelf 1 in the unhooked state. The projection 16 contains a first projection section 17 and a second projection section 18. In particular, a notch 19 is arranged between the first projection section 17 and the second projection section 18. In particular, the first projection section 17 contains a suspension element 20 which is configured to be received in the slot 7 of the retaining frame 4, see FIG. 1 or FIG. 2. According to the present exemplary embodiment, the second projection section 18 is configured as a support element which is configured to rest on the rear side 6 of the retaining frame 4, see FIG. 1 or FIG. 2.

According to the present embodiment, the suspension element 20 is obtainable by making the notch 19 and then bending it around a bending axis that is arranged vertically in the installed state. In particular, the first projection section 17 can be bent around two different bending lines that are vertical in the installed state, so that the first projection section has a U-shape when viewed from above. In particular, the first projection section 17 contains the suspension element 20, which is configured to be received in the slot of the retaining frame. The suspension element 20 may have a width that is greater at or near its upper edge than at its lower edge. In particular, the width may decrease continuously at least in sections. Such a suspension element 20 can be inserted particularly easily into the corresponding slot 7.

According to the present embodiment, the upper wall section 21 contains the projection 16 and the first projection section 17 contains the suspension element 20. The suspension element 20 is configured such that, when installed, it can be hooked into a corresponding slot 7 on the rear side 6 of the retaining frame 4. The suspension element 20 has a greater depth than the first projection section 17. This allows the suspension element 20 to rest with its lower end 26 on the inside of the rear side 6 of the retaining frame 4.

FIG. 4 also shows part of groove 23 in the first side wall 11, which runs from its rear end toward the front wall 13, so that the first side wall 11 can be divided into an upper wall section 21 and a lower wall section 22 by the groove 23.

FIG. 4 also shows that the rear wall 14 does not extend to the first side wall 11, but that a cutout 25 is arranged between a first end 24 of the rear wall 14 and the first side wall 11. This cutout 25 is at least as wide as the retaining frame 4, in other words, the cutout 25 has a width that is at least as large, but usually slightly larger, than the distance between the first side surface 8 and the second side surface 9 of the corresponding retaining frame 4, see FIGS. 1 to 3, which show at least one of the two retaining frames 4.

It is obvious to a person skilled in the art that many other variants are possible in addition to the embodiments described without departing from the inventive concept. The subject matter of the invention is therefore not limited by the preceding description and is determined by the scope of protection defined by the claims. The broadest possible interpretation of the claims is decisive for the interpretation of the claims or the description. In particular, the terms "contain" or "include" should be interpreted as referring to elements, components, or steps in a non-exclusive sense, meaning that the elements, components, or steps may be present or used, and may be combined with other elements, components, or steps that are not explicitly mentioned. If the claims refer to an element or component from a group that may consist of A, B, C to N elements or components, this wording shall be interpreted as meaning that only a single element from this group is required, and not a combination of A and N, B and N, or any other combination of two or more elements or components from this group.

What is claimed is:

1. A suspension device comprising at least one shelf and a retaining frame, wherein the at least one shelf has a base surface, a first side wall, a second side wall, a front wall and a rear wall, wherein the front wall is arranged opposite the rear wall and the first side wall is arranged opposite the second side wall, wherein the first side wall, the front wall, the second side wall and the rear wall enclose the base surface, wherein the retaining frame is configured as a profile element with a hollow profile, wherein the retaining frame has a front side which is arranged adjacent to the rear wall of the at least one shelf, wherein the retaining frame has a rear side which is arranged opposite the front side, wherein at least one of the first side wall, the second side wall, or the rear wall includes a projection which is configured to be received in a slot of the retaining frame, wherein the slot is located on the rear side, wherein each of the first side wall and the second side wall contains a groove which extends from the rear wall in a direction of the front wall, so that said corresponding first side wall or second side wall can be divided into an upper wall section and a lower wall section by the groove in an assembled state.

2. The suspension device of claim 1, wherein the front side is free of slots.

3. The suspension device of claim 1, wherein a first side surface and a second side surface extend between the front side and the rear side.

4. The suspension device of claim 3, wherein at least one of the first side surface or the second side surface is free of slots.

5. The suspension device of claim 1, wherein the projection includes a first projection section and a second projection section.

6. The suspension device of claim 5, wherein a notch is arranged between the first projection section and the second projection section.

7. The suspension device of claim 5, wherein the first projection section contains a suspension element which is configured to be received in the slot of the retaining frame.

8. The suspension device of claim 5, wherein the second projection section is configured as a support element which is configured to rest on the rear side of the retaining frame.

9. The suspension device of claim 1, wherein the groove has a length which is in a range of 10% up to and including 40% of a total length of the first side wall or the second side wall.

10. The suspension device of claim 1, wherein the upper wall section contains the projection.

11. The suspension device of claim 7, wherein the upper wall section is deflectable relative to the lower wall section so that the projection can be guided around the retaining frame for bringing the suspension element into engagement with the slot.

12. The suspension device of claim 1, wherein the rear wall has a distance from each of the first side wall and the second side wall which is slightly greater than the distance between a side surface and an opposite side surface of a corresponding retaining frame, so that a corresponding retaining frame is configured to be received for assembly between the first side wall and the rear wall or between the second side wall and the rear wall.

13. The suspension device of claim 1, wherein the first side wall and the second side wall project beyond the rear wall so that a corresponding first side wall or second side wall can rest on a corresponding first side surface or second side surface of the retaining frame when installed.

14. An extendable cabinet element comprising a suspension device comprising at least one shelf and a retaining frame, wherein the at least one shelf has a base surface, a first side wall, a second side wall, a front wall and a rear wall, wherein the front wall is arranged opposite the rear wall and the first side wall is arranged opposite the second side wall, wherein the first side wall, the front wall, the second side wall and the rear wall enclose the base surface, wherein the retaining frame is configured as a profile element with a hollow profile, wherein the retaining frame has a front side which is arranged adjacent to the rear wall of the at least one shelf, wherein the retaining frame has a rear side which is arranged opposite the front side, wherein at least one of the first side wall, the second side wall, or the rear wall includes a projection which is configured to be received in a slot of the retaining frame, wherein the slot is located on the rear side, wherein each of the first side wall and the second side wall contains a groove which extends from the rear wall in a direction of the front wall, so that said corresponding first side wall or second side wall can be divided into an upper wall section and a lower wall section by the groove in an assembled state.

15. A rotatable or swiveling cabinet element containing a suspension device comprising at least one shelf and a retaining frame, wherein the at least one shelf has a base surface, a first side wall, a second side wall, a front wall and a rear wall, wherein the front wall is arranged opposite the rear wall and the first side wall is arranged opposite the second side wall, wherein the first side wall, the front wall, the second side wall and the rear wall enclose the base surface, wherein the retaining frame is configured as a profile element with a hollow profile, wherein the retaining frame has a front side which is arranged adjacent to the rear wall of the at least one shelf, wherein the retaining frame has a rear side which is arranged opposite the front side, wherein at least one of the first side wall, the second side wall, or the rear wall includes a projection which is configured to be received in a slot of the retaining frame, wherein the slot is located on the rear side, wherein each of the first side wall and the second side wall contains a groove which extends from the rear wall in a direction of the front wall, so that said corresponding first side wall or second side wall can be divided into an upper wall section and a lower wall section by the groove in an assembled state.

* * * * *